United States Patent [19]

Mizuno

[11] 4,311,307

[45] Jan. 19, 1982

[54] BALLS FOR SPORTS

[75] Inventor: Masato Mizuno, Tokyo, Japan

[73] Assignee: Mizuno Corporation, Osaka, Japan

[21] Appl. No.: 107,606

[22] Filed: Dec. 27, 1979

[30] Foreign Application Priority Data

Dec. 29, 1978 [JP] Japan ..... 53/183037[U]

[51] Int. Cl.[3] ..... A63B 41/00

[52] U.S. Cl. ..... 273/65 B; 273/65 EB; 137/223

[58] Field of Search ..... 273/65 D, 65 C, 58 R, 273/65 EB, 65 B; 428/12, 11; 137/223, 844, 846

[56] References Cited

U.S. PATENT DOCUMENTS

| | | | |
|---|---|---|---|
| 1,587,392 | 6/1926 | MacDonald | 273/65 D |
| 2,142,414 | 1/1939 | Riddell | 273/65 D |
| 2,743,510 | 5/1956 | Mauney et al. | 428/12 |
| 3,100,641 | 8/1963 | Nicholls et al. | 137/223 X |
| 3,132,988 | 5/1964 | Fowler | 428/11 |
| 3,533,890 | 10/1970 | Nesbit | 428/11 |
| 4,012,041 | 3/1977 | Hoffman | 273/65 D X |
| 4,070,434 | 1/1978 | Noda | 273/65 D |

*Primary Examiner*—Henry F. Epstein

*Attorney, Agent, or Firm*—Fleit & Jacobson

[57] ABSTRACT

There is provided a ball for sports in which an air injection valve attached to a rubber inner tube is covered by outer layers so as not to be exposed. An aperture for insertion of an air injection needle is provided in the outer layers so that it is in alignment with the hole for insertion of an air injection needle of the air injection valve.

3 Claims, 3 Drawing Figures

BALLS FOR SPORTS

BACKGROUND OF THE INVENTION

This invention relates to improvements in balls for sport, such as balls used in volleyball, basketball, etc.

The ball is filled with air by inserting an air injection needle into a hole for air injection needle of an air injection valve attached to the rubber inner tube of the ball and by penetrating the leading end of the needle into a slit of the air injection valve, which is usually closed to prevent air from escaping from the interior of the ball.

In the construction of the conventional ball, the air injection valve is attached to the rubber inner tube of the ball so that its upper end portion projects from the rubber inner tube. An envelope or outer layers comprising a yarn-winding layer, a rubber cushion layer and a skin layer made of leather or rubber are provided on the inner tube at the overall circumferential surface thereof, except for the projecting upper end portion of the valve. The outer layers surround the valve at the upper end portion thereof and the outer surface of the outermost skin layer is so adapted as to be flush with or lie on the same plane as the upper end surface of the valve. Thus, the skin layer and the upper end portion of the valve form a continuous smooth surface.

Although the upper end portion of the valve and the skin layer form a smooth surface, since the upper end surface of the valve is exposed and made of a material harder than that of the skin layer, the exposed upper end surface feels hard. Therefore, when the exposed upper end portion strikes the body of a player especially the hands and legs during play, the player feels pain. Especially in the case of volleyball, when a player receives a strongly served ball or blocks a spiked ball, the player suffers acute pain in that part of the body which has been struck by the exposed upper end portion of the valve. This often would result in a bruise.

SUMMARY OF THE INVENTION

It is an object of the invention to provide an improved ball which eliminates the above-mentioned disadvantages of the conventional ball.

It is a further object of the invention to provide an improved ball wherein its valve portion made of a material harder than leather, rubber, etc of which the skin layer is made is so adapted that it will not come into direct contact with a hand or a leg of a player. This adaptation would give a uniform feeling throughout the whole surface of the ball, and thereby prevent a player from feeling acute pain when the ball strikes the player.

In accordance with the present invention, there is provided a ball comprising an inner tube, an air injection valve attached to the inner tube and outer layers covering the inner tube and the valve, the outer layers being provided with an aperture for insertion of an air injection needle just above the air injection hole of the valve.

DESCRIPTION OF THE DRAWINGS

Other objects and advantages of the present invention will become apparent from the following description made with reference to the accompanying drawings, in which.

DESCRIPTION OF THE PREFERRED EMBODIMENTS

Embodiments of the present invention will now be described in detail with the reference to the accompanying drawings.

Figure 1:
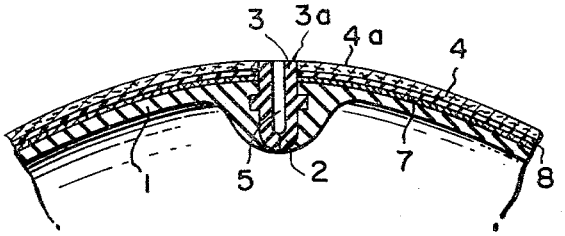
FIG. 1 PRIOR ART
FIG. 1 is a cross-sectional view showing the main portion of the conventional ball.

First referring to FIG. 1 showing the construction of the conventional ball for better understanding of the present invention, an air injection valve (2) is attached to a rubber inner tube (1) so that its upper end portion (3) projects from the inner tube (1). An envelope or outer layers comprising a yarn-winding layer (7), a rubber cushion layer (8) and a skin layer (4) made of some type of leather or rubber are provided on the inner tube (1) at the overall circumferential surface thereof, except for the upper end portion (3). The outer layers surround the valve (2) at the upper end portion thereof and the outer surface (4*a*) of the outermost skin layer (4) is so adapted as to be flush with the upper end surface (3*a*) of the upper end portion (3).

Since the exposed upper end portion (3) is made of a material harder than that of the skin layer (4), it feels hard. When the exposed upper end portion strikes the body of a player, the player feels acute pain, as mentioned above.

The preferred embodiments of the present invention which eliminate above disadvantages will be explained in connection with FIGS. 2 and 3 wherein similar parts as those in FIG. 1 are indicated by like numerals.

The air injection valve (2) of a conventional configuration is attached to the rubber inner tube (1) in a conventional manner. The valve (2) is of such a size that the upper end surface (3*a*) of the upper end portion (3) is flush with the outer surface (1*a*) of the inner tube (1). The valve (2) is covered by the outer layers comprising the yarn-winding layer (7), the rubber cushion layer (8) and the skin layer (4). An aperture (6) for insertion of the air injection needle is provided on the outer layers (7, 8, and 4) just above the hole (5) so that it is in alignment with the hole (5).

Figure 2:
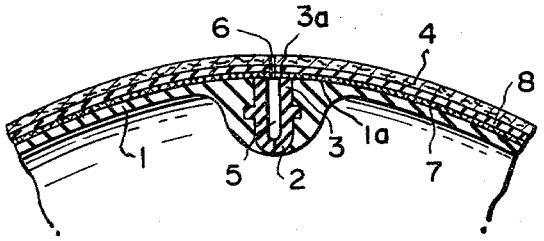
FIG. 2 is a cross-sectional view showing the main portion of the ball according to the invention.
Figure 3:
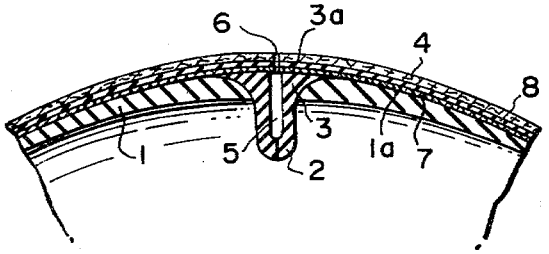
FIG. 3 is a cross-sectional view showing another embodiment of the ball.

In the embodiment of FIG. 2, the valve which is accommodated in the lump portion of the inner tube is utilized and in the embodiment of FIG. 3, the valve which projects at the lower portion thereof from the inner tube into the interior of the ball is utilized.

As is clear from the above description, the ball according to the present invention is constructed so that the upper end portion of the valve attached to the inner tube is adapted to be flush with the outer surface of the inner tube and is covered by the outer layers and only the aperture is exposed at the skin layer. Therefore, the feeling from touching the ball is uniform for whole surface of the ball and at the same time neither pain nor bruise will result from contact with the ball even if the player receives a strongly served ball or blocks a spiked ball.

What is claimed is:

1. A pneumatic ball comprising a rubber bladder fitted with a valve having an air passage therethrough and a plurality of outer layers covering the rubber bladder, wherein the upper end surface of the valve is flush with the outer surface of the bladder and is covered with said outer layers, which outer layers include a yarn-winding layer, a rubber cushion layer and a skin layer and wherein said outer layers are provided with an aperture extending through the outer layers, immediately above said air passage of the valve.

2. A ball as set forth in claim 1, wherein the yarn-winding layer is enclosed within the rubber cushion layer, and the rubber cushion layer is enclosed within the skin layer.

3. A ball as set forth in claim 1 or claim 2, wherein the lowest portion of the valve projects from the bladder into the interior of the ball.

* * * * *